US006591564B2

(12) United States Patent
Cusimano

(10) Patent No.: US 6,591,564 B2
(45) Date of Patent: Jul. 15, 2003

(54) GROUND-ANCHOR BRACE SYSTEM FOR MODULAR BUILDINGS

(76) Inventor: Matt Cusimano, 943 E. Goshen Ave., Fresno, CA (US) 93720

( * ) Notice: Subject to any disclaimer, the term of this patent is extended or adjusted under 35 U.S.C. 154(b) by 0 days.

(21) Appl. No.: 09/974,034

(22) Filed: Oct. 10, 2001

(65) Prior Publication Data

US 2003/0066251 A1 Apr. 10, 2003

(51) Int. Cl.[7] ..... F16M 13/00; A45F 3/44; E02D 27/42; E04B 5/00

(52) U.S. Cl. ..... 52/274; 52/DIG. 3; 52/299; 52/DIG. 11; 248/156; 248/530

(58) Field of Search ..... 52/DIG. 11, DIG. 3, 52/274, 299; 248/530, 156

(56) References Cited

U.S. PATENT DOCUMENTS 3,830,457 A * 8/1974 Stewart
4,148,162 A * 4/1979 Goodrich
4,429,851 A * 2/1984 DeJager
4,937,989 A * 7/1990 Miyares
5,503,500 A 4/1996 Oliver et al.
5,575,492 A * 11/1996 Stone ..... 280/475
5,697,191 A * 12/1997 MacKarvich
5,784,844 A * 7/1998 MacKarvich
5,797,226 A * 8/1998 MacKarvich
5,850,718 A * 12/1998 MacKarvich
5,873,679 A * 2/1999 Cusimano
6,058,663 A * 5/2000 MacKarvich
6,176,056 B1 * 1/2001 MacKarvich
6,309,165 B1 * 10/2001 Hahn ..... 414/401

* cited by examiner

*Primary Examiner*—Carl D. Friedman
*Assistant Examiner*—Kevin McDermott
(74) *Attorney, Agent, or Firm*—Robert Charles Hill

(57) ABSTRACT

A pier support system comprises a support pier with a load-spreading plate that is laterally braced at the top to an anchor plate pinned to the ground just under the periphery of a modular building. The support pier is placed directly under the support girders of the modular building at critical points, and the lateral bracing runs outboard at a down angle of 35°–55°. Sufficient working room exists just inside the periphery of the modular building for large pinning rods to be driven into the ground through the anchor plate.

15 Claims, 3 Drawing Sheets

GROUND-ANCHOR BRACE SYSTEM FOR MODULAR BUILDINGS

BACKGROUND OF THE INVENTION

1. Field of the Invention

The present invention relates to ground anchors, and more particularly to bracing systems that keep modular buildings securely on their foundations during seismic shaking or high winds.

2. Description of Related Art

Modular buildings are usually supported underneath by large steel girders and beams. In California, the bottoms of these beams are permitted to be 12"–36" above the ground. The typical installation places piers and other supports directly under key points, and these then bear on the ground. Such a pier support is described by James Oliver, et al., in U.S. Pat. No. 5,503,500, issued Apr. 2, 1996.

Some ground is far too soft to place the full load of a support pier on a small patch of soil. So, James Oliver, et al., describe a system of pier support plates that spread the weight over several square feet. Heavy nails are used to pin the system to the ground and prevent side slipping.

A seismic foundation pier with its own ground anchoring is described by the present inventor, Matt Cusimano, in U.S. Pat. No. 5,873,679, issued Feb. 23, 1999. The bottom struts of a pier have pin guides that steer and hold large pinning rods into the ground. Such rods are suggested to be 15"–20" long, and are driven in with a hammer.

Unfortunately, deep under a modular building, especially just under its support girders, there is very little room to swing a hammer and drive such pinning rods fully into the ground. This situation is exacerbated when the bottoms of the girders are less that 24" above the ground. What is needed is a pier support system that puts the pinning rods in a better position for a more efficient installation overall.

SUMMARY OF THE INVENTION

Briefly, a pier support system embodiment of the present invention comprises a support pier with a load-spreading plate that is laterally braced at the top to an anchor plate pinned to the ground just under the periphery of a modular building. The support pier is placed directly under the support girders of the modular building at critical points, and the lateral bracing runs outboard at a down angle of 35°–55°. Sufficient working room exists just inside the periphery of the modular building for large pinning rods to be driven into the ground through the anchor plate.

An advantage of the present invention is that a pier support system is provided that is secure and effective.

Another advantage of the present invention is that a pier support system is provided that is easy to install correctly.

A further advantage of the present invention is that a pier support system is provided that can be economically manufactured.

The above and still further objects, features, and advantages of the present invention will become apparent upon consideration of the following detailed description of specific embodiments thereof, especially when taken in conjunction with the accompanying drawings.

BREIF DESCRIPTION OF THE DRAWINGS

DETAILED DESCRIPTION OF THE INVENTION

Figure 1:
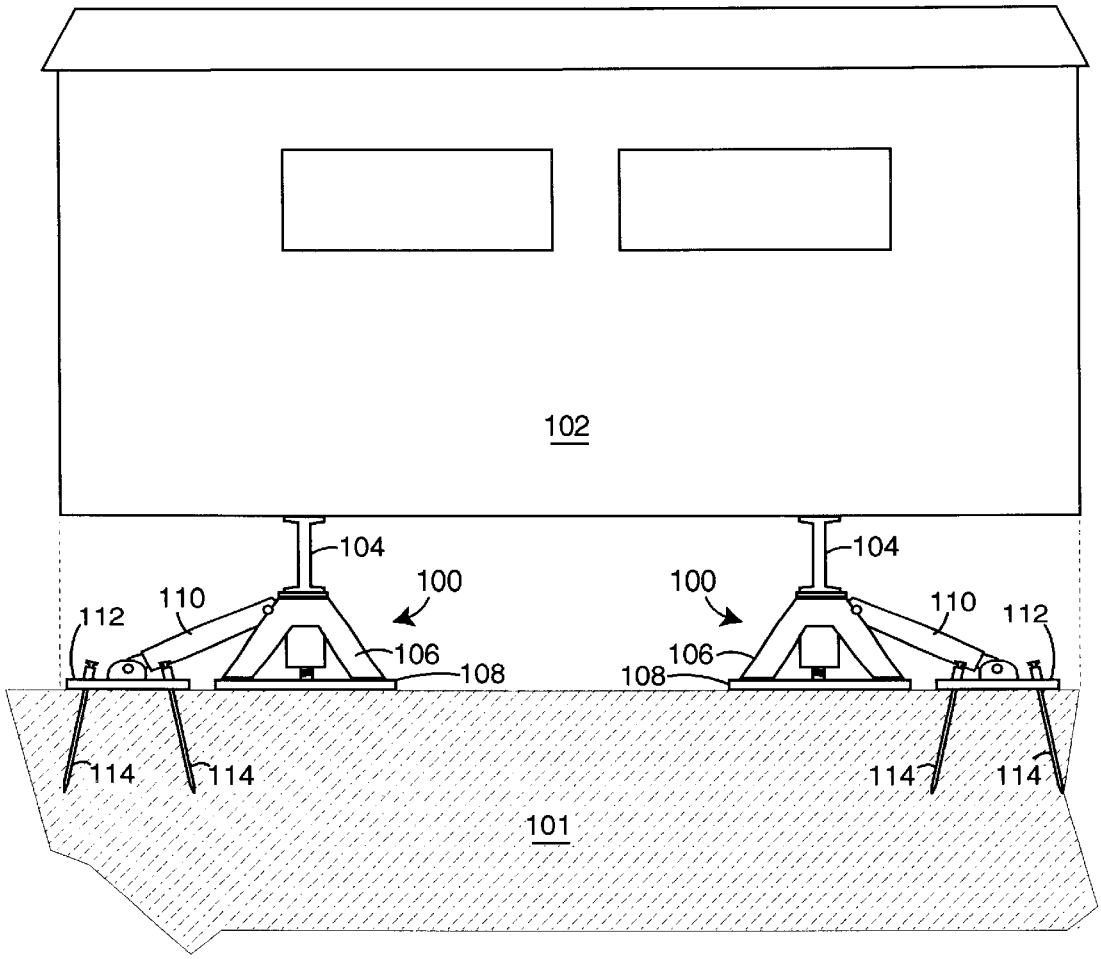
FIG. 1 is an end view diagram of a pier support system embodiment of the present invention.

FIG. 1 illustrates a pier support system embodiment of the present invention, referred to herein by the reference numeral 100. The pier support system 100 sits atop the ground 101 and supports a modular building 102. A system of steel girders 104 are a major structural part of modular building 102 and bear all the weight. Each pier support system 100 comprises an adjustable support pier 106 that sits over a weight spreading plate 108. A lateral brace 110 runs outboard the building at a preferred down angle of 35°–55°, with 45° being optimum. A ground anchor 112 receives the outboard end of the brace 110 and is pinned to the ground with pinning rods 114.

The full weight of the modular building can easily run 9500 pounds, and is supported in full by at least four support piers 106. Practically all the lateral loads of the modular building are braced-off by the ground anchors 112, pinning rods 114, and rigid bracing 110. The expected lateral loads, e.g., from seismic activity, can range to 8500 pounds. It may be advantageous in some installations to match two ground anchors with their braces arrayed 90° apart to each support pier so ground shaking in any compass direction can be resisted at a single pier.

Figure 2:
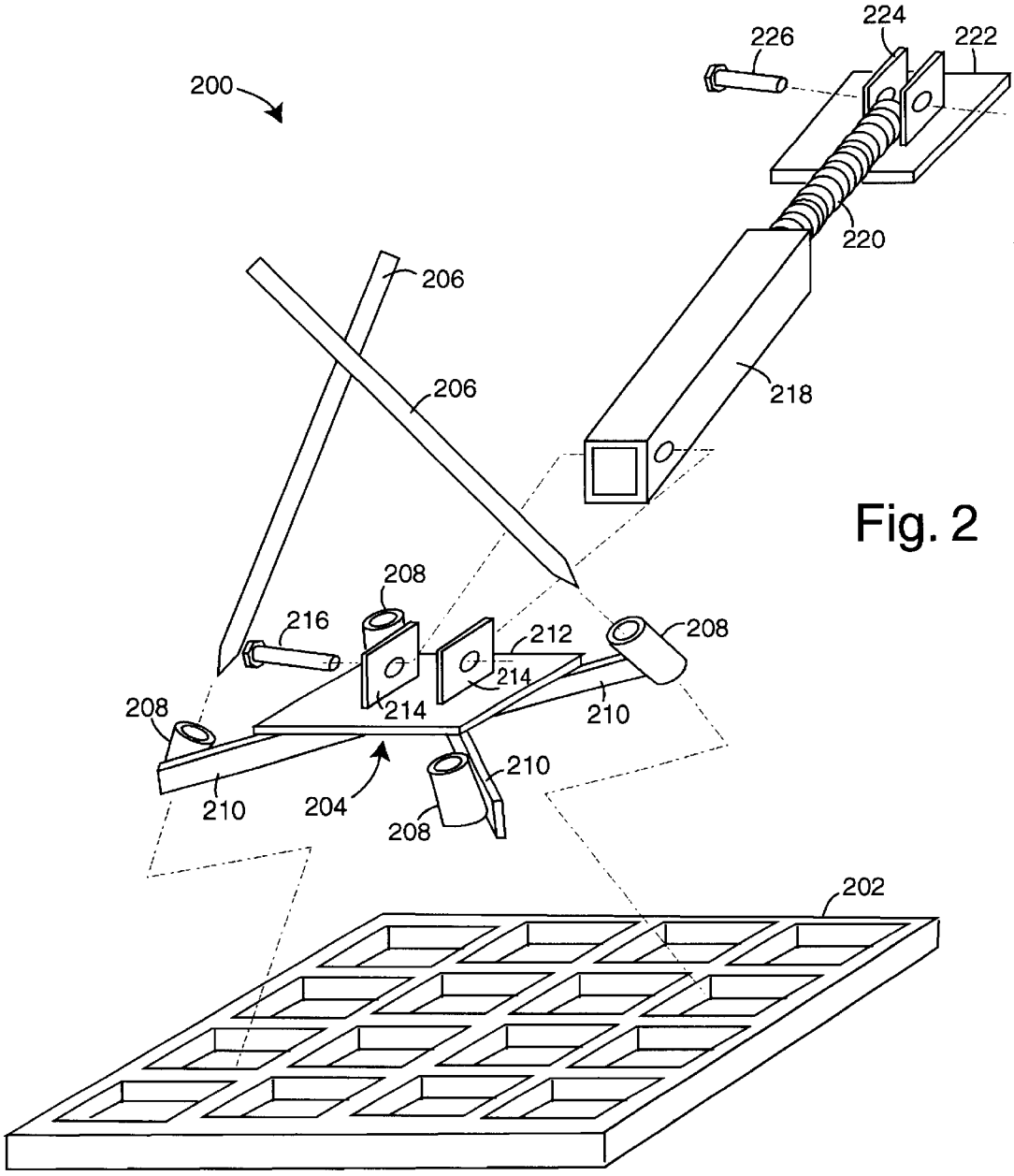
FIG. 2 is a perspective diagram of a ground anchor embodiment of the present invention that can be used as a part of the system shown in FIG. 1.

FIG. 2 illustrates a ground anchor embodiment of the present invention and is referred to herein by the general reference numeral 200. The ground anchor 200 is similar to the combination of ground anchor 112, brace 110 and pinning rods 114, in FIG. 1. Ground anchor 200 comprises a weight-spreading ground plate 202 that is intended to lie in direct contact with the ground. In preferred embodiments it is made of ABS plastic and includes webbing reinforcements for strength and rigidity. A pinning assembly 204 is made of steel and lies on top of the ground plate 204. During installation, it is staked in place with four large nails, as represented by pinning rods 206. These are guided to spread out at an angle into the ground by a set of guide pockets 208 welded at the ends of arms 210. A central plate 212 is welded to the arms 210 and has a pair of flanges 214 welded on top. A bolt 216 secures a brace arm 218.

The brace arm 218 is adjustable in length by virtue of a threaded rod 220. A support-pier attachment plate 222 has a pair of flanges 224 that use a bolt 226 to capture the end of the threaded rod 220. The support-pier attachment plate 222 is typically welded or bolted to the top of the support pier 106 (FIG. 1) just under the girder beam 104.

A prototype of the ground anchor 200 that provided good results used ¼" plate mild steel for plates 212 and 222, and also for flanges 214 and 224. The arms 210 were made of ⅜" by 1-½" mild steel, and the pinning rods 206 were ¾" diameter type-304 stainless steel. The bolts 216 and 226 were ½" coarse-threaded Grade-5. The brace arm 218 was 1" box-section steel, and the threaded rod 220 was ¾" diameter with 4.5 threads-per-inch.

Figure 3A:
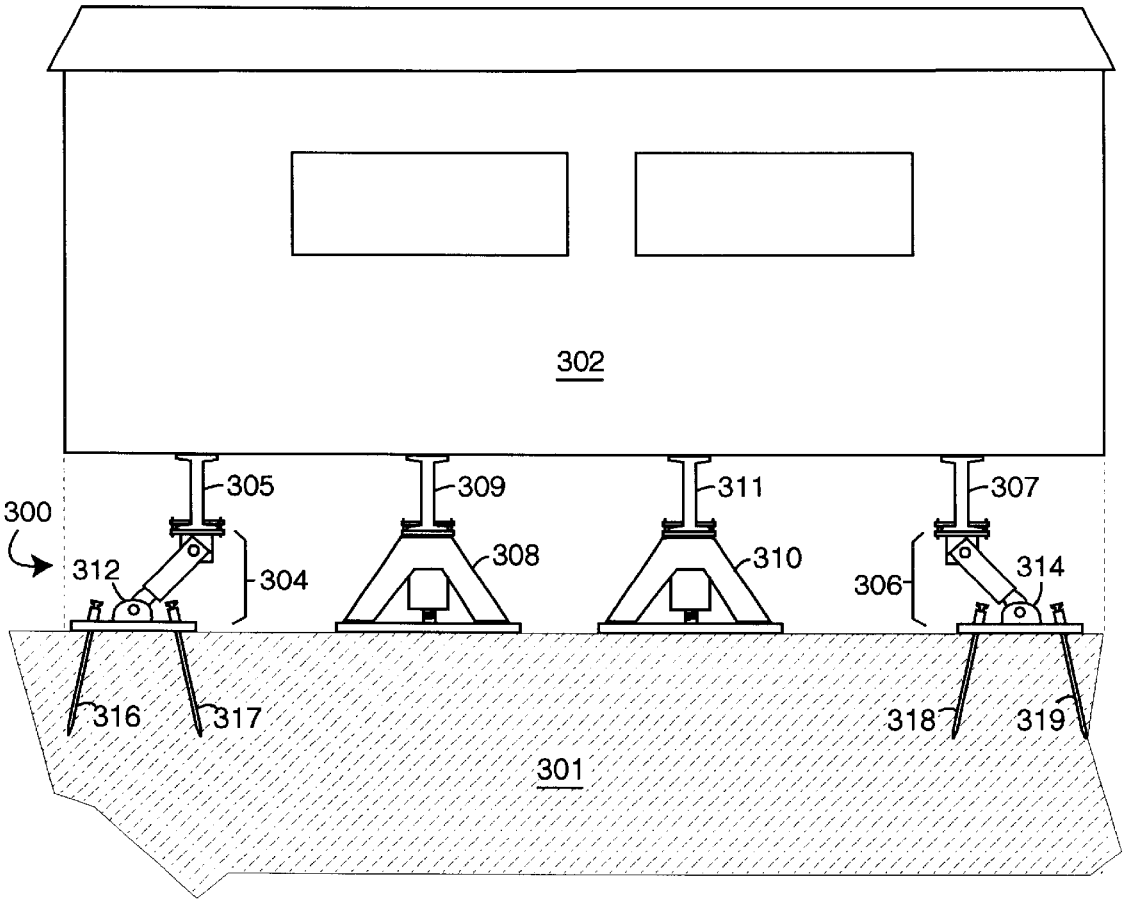
FIG. 3A is a diagram of a modular building support system embodiment of the present invention in which ground anchor braces are positioned around the perimeter and the building weight is supported by piers inside the perimeter.

FIG. 3A illustrates a modular building support system 300, in an embodiment of the present invention. The ground 301 is shown in cross-section and supports a modular building 302. A lateral support brace 304 is attached to the bottom of an I-beam 305 which is a structural part of the modular building 302. Similarly on the opposite side, another lateral support brace 306 is attached to the bottom of an I-beam 307. In between, a pier 308 supports a main-support I-beam 309, and a pier 310 supports another main-support I-beam 311. A ground plate 312 and 314 are respectively anchored to the ground 301 by hammer driven pins 316–319. In general, the ground anchor braces are positioned around the perimeter and the building weight is supported by piers inside the perimeter.

Figure 3B:
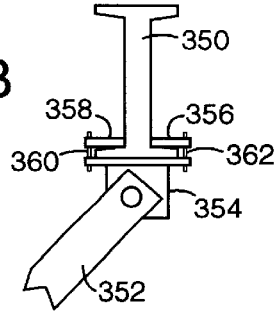
FIG. 3B is an end view of the attachment of one of the ground anchor braces to a I-beam under the modular building of FIG. 3A.

FIG. 3B is an end view of the attachment of one of the ground anchor braces to an I-beam 350 under the modular building of FIG. 3A. A diagonal brace arm 352 is attached with a bolt to a cleat 354. A pair of gripper plates 356 and 358 are used to capture and clamp tight the cleat 354 to the I-beam 350. A pair of bolts 360 and 362 are used to draw the assembly tight and lock it together.

Although particular embodiments of the present invention have been described and illustrated, such is not intended to limit the invention. Modifications and changes will no doubt become apparent to those skilled in the art, and it is intended that the invention only be limited by the scope of the appended claims.

What is claimed is:

1. A modular building pier support system, comprising:

a support pier for providing above-ground support to a modular building directly under a support girder;

a ground anchor for placement outboard of the support pier and yet still under said modular building and near the modular building's periphery;

a set of pinning rods for driving through the ground anchor to secure the ground anchor to the ground; and a rigid brace arm fastened to the ground anchor and attached to an upper portion of the support pier such that the down angle from the support pier is in the range of 35°–55°; wherein the support pier includes a flat weight-spreading plate for contact with soft ground.

2. The system of claim 1, wherein:

the ground anchor includes a weight-spreading plate for contact with soft ground.

3. The system of claim 1, wherein:

the set of pinning rods fit into guide pockets in the ground anchor set at a spreading angle.

4. The system of claim 1, wherein:

the ground anchor includes a weight-spreading plate for contact with soft ground; and the set of pinning rods fit into guide pockets in the ground anchor set at a spreading angle and pierce through said weight-spreading plate after installation.

5. The system of claim 1, wherein:

the rigid brace arm has an adjustable length.

6. The system of claim 5, wherein;

the rigid brace arm has a threaded rod to provide an adjustable length.

7. A modular building support system, comprising:

a support pier for providing above-ground support to a modular building directly under a first support girder;

a second support girder;

a ground anchor for placement outboard of said second support girder and yet still under said modular building near its periphery;

a set of pinning rods for driving through the ground anchor to secure it to the ground;

a rigid brace arm fastened to the ground anchor and attached to said second support girder such that a down angle from the support pier is in the range of 35°–55°; and a gripper plate for locking a bottom webbing of said second support girder to the rigid brace arm under said modular building.

8. A method of securing the foundations of a modular building:

placing a supporting pier directly under a modular building girder; and pinning a ground anchor outboard of said supporting pier and inside the periphery of said modular building;

connecting a rigid brace arm between the top of the supporting pier and the ground anchor such that it has an outboard down-angle of 35° to 55°;

wherein, the ground anchor can be installed with pinning rods at a place just inside the periphery of the modular building where there is increased overhead workroom.

9. A modular building pier support system, comprising:

a support pier for providing above-ground support to a modular building directly under a support girder;

a ground anchor for placement outboard of the support pier and yet still under said modular building and near the modular building's periphery;

a set of pinning rods for driving through the ground anchor to secure the ground anchor to the ground;

a rigid brace arm fastened to the ground anchor and attached to an upper portion of the support pier such that the down angle from the support pier is in the range of 35°–55°; and a gripper plate for locking a bottom webbing of a structural beam under said modular building to the rigid brace arm.

10. The system of claim 9, wherein:

the support pier includes a weight-spreading plate for contact with soft ground.

11. The system of claim 9, wherein:

the ground anchor includes a weight-spreading plate for contact with soft ground.

12. The system of claim 9, wherein:

the set of pinning rods fit into guide pockets in the ground anchor set at a spreading angle.

13. The system of claim 9, wherein:

the ground anchor includes a weight-spreading plate for contact with soft ground; and the set of pinning rods fit into guide pockets in the ground anchor set at a spreading angle and pierce through said weight-spreading plate after installation.

14. The system of claim 9, wherein:

the rigid brace has an adjustable length.

15. The system of claim 14, wherein:

the rigid brace arm has a threaded rod to provide an adjustable length.

* * * * *